United States Patent [19]

Benjamin

[11] 4,061,233

[45] Dec. 6, 1977

[54] DRILLING RIGS

[76] Inventor: Joseph Reginald Benjamin, Fifth Floor, 38 Savile Row, London, W1X 2QU, England

[21] Appl. No.: 700,478

[22] Filed: June 28, 1976

[30] Foreign Application Priority Data

July 4, 1975 United Kingdom ..... 28401/75

[51] Int. Cl.[2] ..... E21B 19/14

[52] U.S. Cl. ..... 214/2.5; 175/85; 214/1 P

[58] Field of Search ..... 214/2.5, 1 P, 152; 175/9, 52, 85; 211/60 S; 61/63

[56] References Cited

U.S. PATENT DOCUMENTS

| | | | |
|---|---|---|---|
| 2,885,096 | 5/1959 | DeJarnett | 214/2.5 |
| 3,177,944 | 4/1965 | Knights | 214/2.5 X |
| 3,265,138 | 8/1966 | Alexander et al. | 214/2.5 X |
| 3,443,647 | 5/1969 | Jenkins et al. | 175/85 |
| 3,539,024 | 11/1970 | Irons et al. | 214/2.5 X |
| 3,650,339 | 3/1972 | Selfe et al. | 175/85 |
| 3,937,334 | 2/1976 | Bleyl et al. | 214/2.5 |
| 3,961,673 | 6/1976 | Wolters et al. | 175/85 X |

FOREIGN PATENT DOCUMENTS

| | | | |
|---|---|---|---|
| 137,853 | 9/1960 | U.S.S.R. | 175/85 |

*Primary Examiner*—Frank E. Werner
*Attorney, Agent, or Firm*—Lawrence E. Laubscher

[57] ABSTRACT

A drilling rig mounted on a bore inclined to the vertical in which transfer of drill strings from a store to the bore is effected on the low side of the rig.

6 Claims, 11 Drawing Figures

DRILLING RIGS

BRIEF DESCRIPTION OF THE PRIOR ART

This invention relates to drilling rigs.

With drilling rigs operating in conjunction with bores inclined to the vertical it has been practice to design them for what is described as "high side working". Thus, in the case of a drilling rig mounted on the casing of large diameter piles, the drilling platform lies in a plane perpendicular to the axis of the bore, and it will be appreciated that a portion of the platform on one side of the axis is higher than the portion of the platform on the other side of the axis. The drill strings which are to be attached to the strings already in the bore as drilling proceeds are stored beneath, and suspended from, the portion of the platform which is on the "high side". The transfer of drill strings from the store to the bore accordingly all takes place on the high side of the platform. The lifting means, for example, a derrick, must be moved to the position in which the lifting tackle is vertically above the drill string in order that the drill string may be lifted from the store. In order to transfer the drill string to the bore, the derrick must be moved to the position in which the drill string can be aligned with the bore. It will be appreciated that, in order to cause the drill strings to be so aligned it is necessary to provide means, such as a hydraulic jack, to urge the lower part of the drill string to the right during the transfer in order to cause the drill string eventually to be aligned with the bore.

SUMMARY OF THE INVENTION

According to one aspect of the invention there is provided a method of transferring elements of a drill string between a store therefor and a bore which is inclined to the vertical comprising the steps of lifting a said element from said store, moving it to a position above said bore and lowering it to said bore, wherein all said steps are carried out on the side of the vertical through the entrance to said bore at which the axis of said bore makes an acute angle to the horizontal.

According to another aspect of the invention there is provided a drilling rig adapted for use in association with bores inclined to the vertical, comprising a drilling platform on which is mounted a lifting device for lifting and transferring elements of a drill string between a store therefor and the bore, the structure of said lifting device being arranged such that such transfer is performed on that side of the vertical through the entrance of said bore at which the axis of said bore makes an acute angle with the horizontal.

BRIEF DESCRIPTION OF THE DRAWING

In order that the invention may be clearly understood and readily carried into effect, embodiments thereof will now be described, by way of example, with reference to the accompanying drawings, in which.

DETAILED DESCRIPTION

Figure 1:
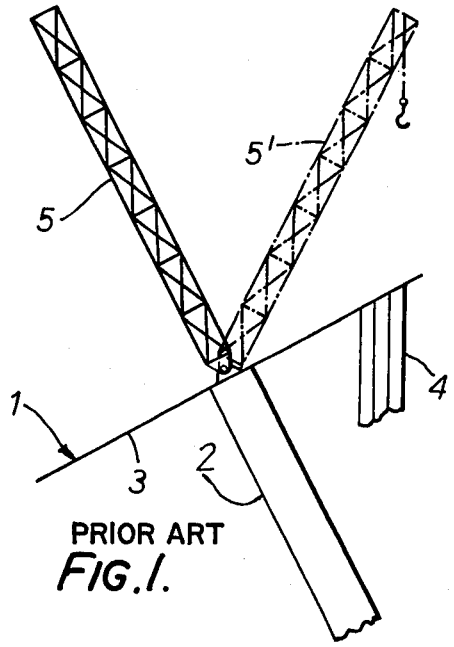
PRIOR ART FIG. 1.
FIG. 1 shows a known form of drilling rig, and has been referred to above.

Referring first more particularly to FIG. 1, a known type of drilling rig 1 is mounted on the casing 2 of large diameter piles, whereby the drilling platform 3 lies in a plane perpendicular to the axis of the bore, and it will be appreciated that the portion of the platform to the right (in the Figure) of the axis is higher than the portion of the platform to the left of the axis. The drill strings 4 which are to be attached to the strings already in the bore as drilling proceeds, are stored beneath, and suspended from, the platform 3 on the right (in the Figure) of the axis, that is at the portion of the platform which is on the "high side". The transfer of drill strings 4 from the store to the bore accordingly all takes place on the high side of the platform. The lifting means, for example, a derrick 5, must be moved to the position 5' in which the lifting tackle is vertically above the drill string 4 in order that the drill string may be lifted from the store. In order to transfer the drill string to the bore, the derrick must be moved to the position 5' in which the drill string can be aligned with the bore. It will be appreciated that, in order to cause the drill strings to be so aligned it is necessary to provide means, such as a hydraulic jack, to urge the lower part of the drill string to the right during the transfer in order to cause the drill string eventually to be aligned with the bore.

Figure 2:
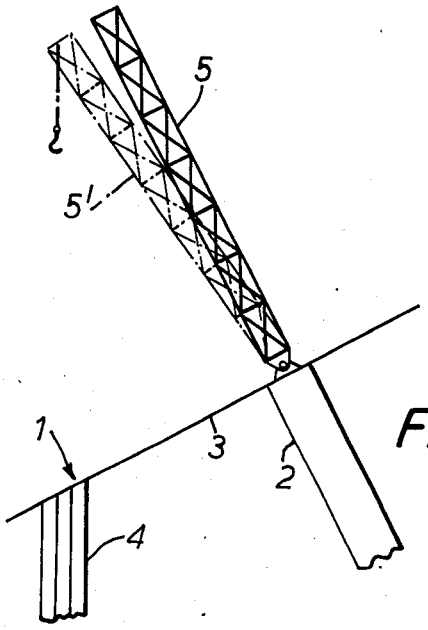
FIG. 2 shows a drilling rig in accordance with the invention.

Referring to FIG. 2, the drilling rig shown is similar to the known drilling rig shown in FIG. 1, but the store of drill strings 4 is on the left side, that is, below the "low side" of the platform 3. In performing transfer of drill strings from the store 4 to the bore it is necessary to move the derrick between the positions 5 and 5'. This is a much smaller angle than the corresponding angle in the arrangement shown in FIG. 1, and it has been found that operations performed on the "low side", as shown in FIG. 2 can be effected much more rapidly than operations performed on the "high side", as shown in FIG. 1. Furthermore, in order to guide a drill string into alignment with the bore, the means to urge the lower part of the drill string into alignment with the bore, being required to provide a pull, can be a cable of hawser. It is not required to provide means such as a hydraulic jack to provide a push.

Figure 4:
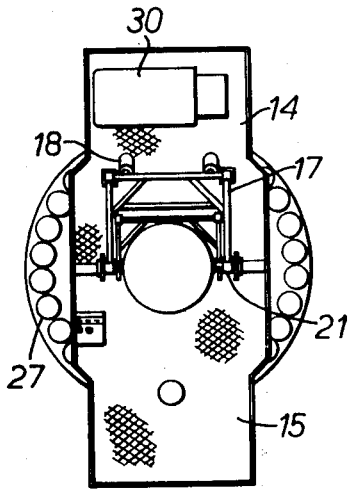
FIG. 4 is a cross-section taken on the line A—A in FIG. 3.
Figure 3:
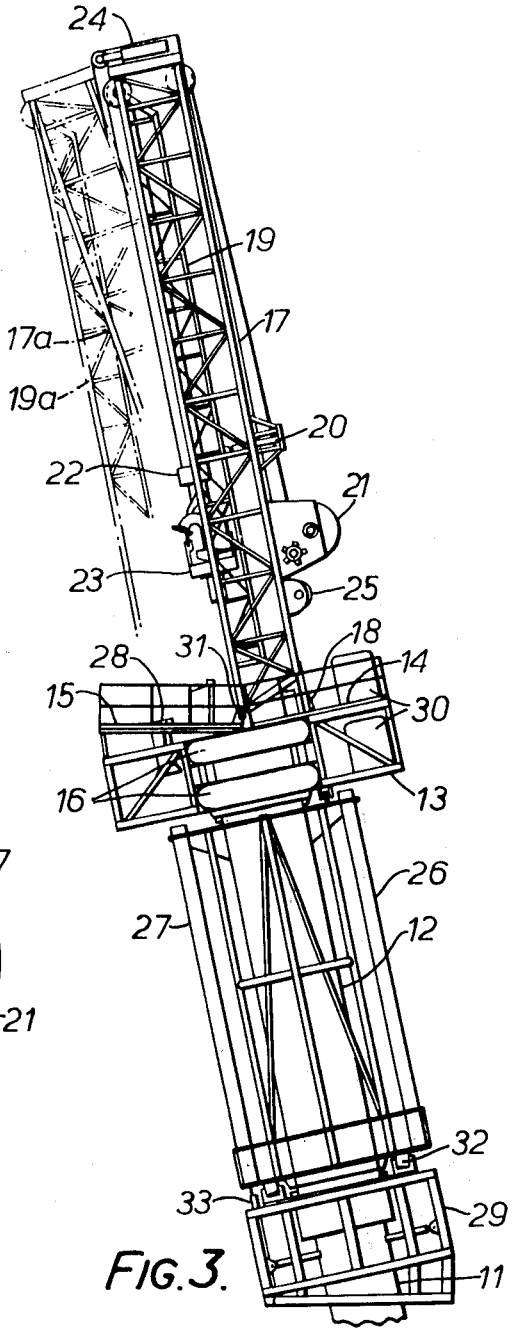
FIG. 3 shows a side view of another drilling rig in accordance with the invention.

The embodiment of a drilling rig now to be described in detail in conjunction with FIGS. 3 and 4 is intended to operate mounted on top of the casing of large diameter piles using threaded drill stem. However, it should be understood that the invention is not limited in its application to using threaded drill stem, and is applicable, for example, also to flange connected drill stem.

Referring to FIGS. 3 and 4, the pile on which the drilling rig is mounted and supported is shown at 11, the pile extending through the tubes forming the core of the rig structure to a sealing inside the tubes a clamp ring assembly 29 being provided, principally to provide reaction to the torque of the rotary unit of the drill. A base frame 13 fabricated in structural steel sections and steel pipes is mounted on top of a column 12, the lower end of which is mounted on the clamp ring assembly 29. The base frame 13 contains storage capacity 16 for fuel and hydraulic fluid. A working platform comprising sections 14 and 15 is mounted on top of the base frame 13. To facilitate working on inclined piling, as shown in FIG. 1, where the portion of the working platform 14 fixed to the base plate 13 will be inclined, the remaining portion 15 of the working platform is hinged so that it may be tilted to the horizontal position.

A derrick 17 is mounted on the base frame 13 above the working platforms 14 and 15. The rig specifically described herein is intended for working with drill stems having a length of 30 feet, and accordingly the derrick is approximately 55 foot long, although the invention may be adapted for use with other drill stem lengths, with suitable scaling of the dimensions. The derrick is hinged at 31 so that it can be tilted by hydraulic means 18, for example to the position shown by dotted lines at 17*a*. A track 19 for guiding the turbo of the rotary unit 23 of the drilling rig upwards and downwards is mounted on the derrick 17 and is inclinable about a top hinge 34 by means of hydraulic rams 20. Thus, when for example, the derrick has tilted to the position 17*a* it is possible for the guide track to be in the position shown at 19*a*. The rotary unit 23 is conventional and is moved up and down along the guide track 19 by means of a hoist 21 suitably powered by hydraulic motors. A travelling block 22 runs along the guide track so as to maintain alignment of the rotary unit of the drill. The power units for the motors are shown at 30.

At the top of the derrick is provided a jib boom 24 which is associated with an auxiliary hoist 25 to provide auxiliary lifting facilities.

Surrounding the column 12 is a circular cage 26 supported by heavy duty rollers 32. This cage in the embodiment specifically described is capable of storing up to 30 30 foot drill stems of 16 inch diameter, one of such stems being shown at 27. The cage may be rotated by means of a hydraulic drive to position any selected drill stem below a mousehole 28 mounted on the base frame 13. A hydraulic ram 33 is provided to lift the selected drill stem in the cage 26 into position in the mousehole 28. The mousehole is pivotable to permit stems to be vertical or in alignment with the carrier cage 26, hydraulic means being provided to pivot the mousehole. The mousehole is provided to suspend drill stems by the upper end in preparation for transfer to the derrick or return to the storage cage 26.

The mode of operation of the drilling rig of FIGS. 3 and 4 is illustrated in the following Table which defines the sequences involved in joint make-up and break-out using threaded drill stem.

TABLE

A. TRIPPING IN

The rig is operated with the rotary unit fitted with a special sub from which hang elevator links.

| | OPERATION | CONCURRENT OPERATION |
|---|---|---|
| 1. | "Boom-over" derrick and extended track to alignment with stem in mousehole. | |
| 2. | Attach links to ears of elevator which is catching stem in the mousehole. | |
| 3. | Lift stem clear of mousehole into track guide, with lower end resting in stem catcher on track guide. | |
| 4. | Boom-back derrick and retract track to drilling position, automatically aligning new stem with top joint of drill string in the pile. | Rotate carrier of pipe rack to bring new stem under mousehole. Elevate stem into mousehole. |
| 5. | Spin up joint with rotary unit. | Swing break-out tool into position. |
| 6. | Close break-out tool and torque-up joint. | |
| 7. | Open break-out tool and swing clear. | |
| 8. | Take up drill string load on main block via rotary unit. | |
| 9. | Remove deck level elevator. | |
| 10. | Lower new joint to level. | Lift and walk elevator to mousehole using secondary line. Secure elevator around new stem in mousehole. Retract stem elevator of pipe rack. Rotate pipe rack. |

REPEAT CYCLE

B. ADDING STEM DURING DRILLING

| | OPERATION | CONCURRENT OPERATION |
|---|---|---|
| 1. | Lower string to hole bottom. | |
| 2. | Drill down one joint. | |
| 3. | Raise string to bring top joint to work level. | |
| 4. | Close deck level elevator. | |
| 5. | Release load of string by easing rotary unit down. | |
| 6. | Swing in break-out tool, close it and break out joint between rotary unit pup sub and top joint of drill string. | |
| 7. | Spin out joint with rotary unit. | |
| 8. | Boom-over derrick and extend track to align rotary unit sub with joint of stem in mousehole. | |
| 9. | Spin up joint with rotary unit. | |
| 10. | Swing over break-out tool. | |
| 11. | Raise joint into tool. | |
| 12. | Close break-out tool, open elevator supporting stem in mousehole. | |
| 13. | Torque up joint. | |
| 14. | Open break-out tool and swing clear. | |
| 15. | Raise new stem attached to rotary unit sub into track and catch lower end in positioner on track. | Retract stem elevator of pipe rack. |
| 16. | Return derrick and track to normal position automatically aligning stem with top joint of drill string. | Rotate pipe rack. Elevate new stem into mousehole. Close elevator around stem or place slips. |
| 17. | Spin up new stem to drill string. | |
| 18. | Swing over break-out tool, close it and torque up joint, open and swing clear. | |
| 19. | Pick-up load of string, open deck level elevator. | |

REPEAT CYCLE

C. TRIPPING OUT (USE ELEVATOR LINK SUB ON ROTARY)

| | OPERATION | CONCURRENT OPERATION |
|---|---|---|
| 1. | Attach elevator links to elevator securing top joint of string at work level. | |
| 2. | Lift string to bring next joint to work level. | |
| 3. | Place a second elevator around pipe at work level. | |
| 4. | Lower string to support in second elevator. | |
| 5. | Swing in break-out tool and break-out joint. | A. Rotate pipe back to bring empty position below mousehole. |
| 6. | Open tool, spin off with rotary unit. | B. Raise stem elevator ram to receive stem. |
| 7. | Boom-over derrick and align track guide with mousehole | |
| 8. | Lower stem into mousehole. | |
| 9. | Open elevator. | |
| 10. | Return derrick to drilling position and set down elevator near pile. | C. Retract stem elevator ram to return stem into rack. |
| | REPEAT | REPEAT |

In the embodiment of the invention described in conjunction with FIGS. 3 and 4, the drill stems 27 are arranged along the circumference of a circle in the cage 26. In an alternative embodiment of the invention, the drill stems are arranged along the circumferences of two concentric circles of different diameter. It will be obvious that the derrick and guide track can be moved into positions in alignment with drill stems in either the inner or the outer ring of the cage.

Figure 5:
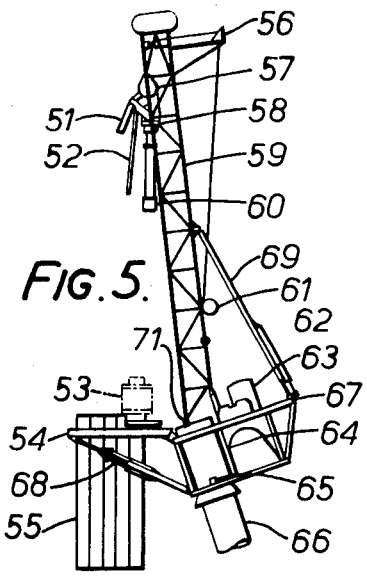
FIGS. 5 to 11 show another drilling rig in accordance with the invention.

Referring now to FIGS. 5 to 11, and more specifically to FIG. 5 there is shown another drilling rig in accordance with the invention. In this rig the store for drill stem is located to one side of the lifting means instead of being coaxial with the pile as in FIGS. 3, 4. In this rig drill string rotation is produced by a rotary table 71 mounted at the pile head and incorporated in the working platform.

The pile on which this rig is mounted is shown at 66 and one part of the drilling platform 67 is mounted on the pile 66 by means of a pile clamp 65. The other part of the drilling platform 54 also serves as a rack for the storage of drill stem which are shown at 55. The portion of the drilling platform 54 is supported by a hydraulic jack 68 by means of which the angle of said platform position can be adjusted. A hoist is shown at 64, a power unit for the rig at 63, and a stabilizer at 53. A derrick 59 is mounted on the platform 67 in pivotable fashion the angle of said derrick being controlled by a hydraulic jack 69. The derrick supports a Kelly 60 by means of a swivel 58 and travelling block 57, there being provided an air hose 52 and a discharge hose 51. At the top of the derrick 59 there is provided a jib boom 56. An auxiliary hoist is shown at 61 with a winch at 62.

Figure 6:
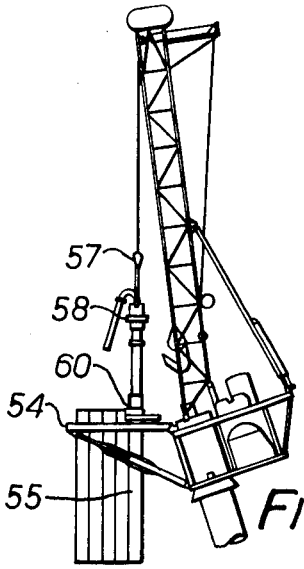
Figure 7:
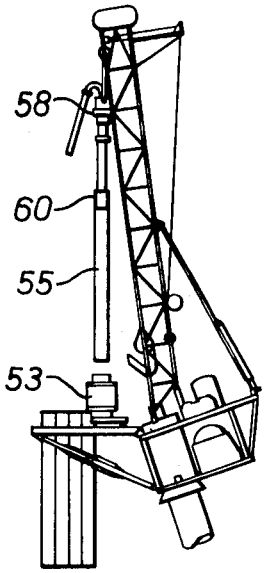
Figure 8:
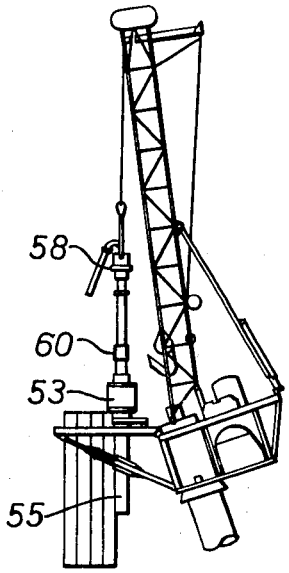
Figure 9:
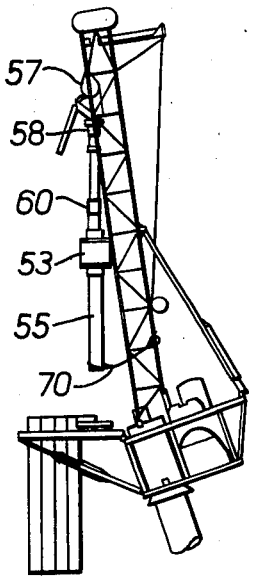
Figure 10:
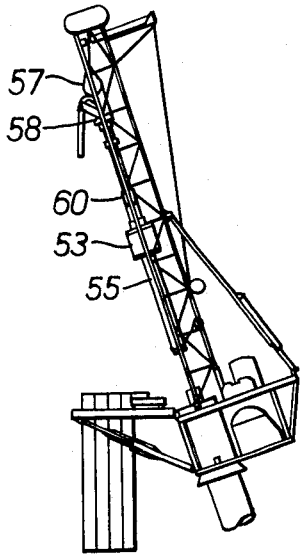
Figure 11:
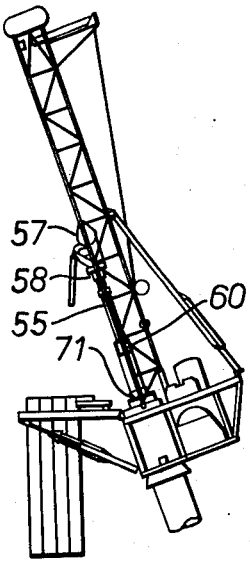

The operation of such a rig is shown in the FIGS. 6 to 11. Starting with the rig as shown in FIG. 5, wherein the travelling block 57, swivel 58 and Kelly 60 are in the raised position, the front derrick legs are unpinned and as shown in FIG. 6 the travelling block 57 is lowered so that the swivel 58 and Kelly 60 are free to pick a drill stem 55 from the rack 54. Then, as shown in FIG. 7 the swivel 58 with Kelly 60 and drill stem 55 are raised. The stabilizer 53 is then pivoted into the picking position. As shown in FIG. 8 the swivel 58 with Kelly 60 and drill stem 55 are lowered through the stabilizer 53 and pinned. The travelling block 57 is then raised as shown in FIG. 9, the swivel 58, Kelly 60, drill stem 55 and stabilizer 53 being cradled by the travelling block 57. A winch chain 70 is then attached to the drill stem 55. All four derrick legs are then pinned, and the swivel 58, Kelly 60, drill stem 55 and stabilizer 53 are pulled into, and lined up with, the front derrick legs ready to be lowered in place on the drill strings already in the bore, as shown in FIG. 10. The winch chain 70 is then removed from the drill stem, and the drill stem is lowered into the bore with the stabilizer as shown in FIG. 11.

It will be obvious to those skilled in the art that many variations of the invention are possible. For example, the rig of FIGS. 3, 4 may be operated without the cage 26 with the base 13 mounted on a pile or on a platform. Furthermore, the cage 13, or carousel, may be located within reach of the boom 24 on, for example, an adjacent piling if there is no platform to support it.

I claim:

1. A drilling apparatus comprising, in combination a. a pile having an axis inclined to the vertical in a plane of inclination;

b. a drill string within said pile;

c. a frame mounted on said pile;

d. a derrick having a foot end and a head end, said foot end pivotally mounted to said frame for angular movement of said derrick in said plane of inclination;

e. drill stem storage means having access means positioned angularly below said pile axis;

f. derrick adjustment means operable to move said derrick head end between a position vertically above said access means and a position on said pile axis;

g. hoisting means on said derrick operable to transfer drill stem from said storage means to said pile with the lower end of said drill stem always positioned in the space angularly below said pile axis; and h. winch means on said derrick intermediate said head and said foot end, said winch means having flexible hauling means engageable with said drill stem during transfer by said hoisting means to control movement of the lower end thereof between said storage means and said pile.

2. A drilling rig assembly according to claim 1 wherein the drilling platform is formed by two portions hinged together whereby one of said portions can be tilted to the horizontal position whilst the other portion remains in a plane perpendicular to the bore axis.

3. A drilling rig assembly according to claim 1, wherein said derrick is provided with a guide track hinged to the top of said derrick and arranged to guide the means for coupling said lifting device to a said drill stem in a predetermined path.

4. A drilling rig assembly according to claim 1, wherein said storage means comprises suspension means for a plurality of said lengths of drill stem located below said drilling platform on that said of the vertical through the entrance to said bore at which the axis of said bore makes an acute angle to the horizontal.

5. A drilling rig assembly according to claim 1, wherein said storage means comprises means mounted for rotation around said pile and arranged to support a plurality of said lengths of drill stem arranged around said pile, and means for rotating said storage means around said pile to align a selected element with said lifting device.

6. A drilling rig assembly according to claim 5, wherein said storage means comprises elevating means for elevating said selected length of drill stem to facilitate securing thereof to said lifting device.

* * * * *